US008770583B2

(12) United States Patent
Segebarth et al.

(10) Patent No.: US 8,770,583 B2
(45) Date of Patent: Jul. 8, 2014

(54) GAME OF CHANCE ENSURING A SINGLE WINNER

(76) Inventors: Larry Segebarth, Frisco, TX (US); Darin L. Peters, Dallas, TX (US)

( * ) Notice: Subject to any disclaimer, the term of this patent is extended or adjusted under 35 U.S.C. 154(b) by 906 days.

(21) Appl. No.: 12/316,313

(22) Filed: Dec. 11, 2008

(65) Prior Publication Data

US 2009/0102125 A1 Apr. 23, 2009

Related U.S. Application Data

(63) Continuation-in-part of application No. 11/323,544, filed on Dec. 30, 2005, now Pat. No. 7,464,933.

(51) Int. Cl.
*A63F 3/06* (2006.01)

(52) U.S. Cl.
USPC ..... 273/139; 273/269; 273/274

(58) Field of Classification Search
USPC ..... 273/269, 139, 274; 463/17–19
See application file for complete search history.

(56) References Cited

U.S. PATENT DOCUMENTS

| | | | | | |
|---|---|---|---|---|---|
| 4,775,155 | A * | 10/1988 | Lees | ..... | 273/139 |
| 5,096,202 | A * | 3/1992 | Hesland | ..... | 273/237 |
| 2007/0152401 | A1 | 7/2007 | Peters et al. | | |

OTHER PUBLICATIONS

"Play the B-Line . . . ", Bonanza Press, 2004.
"Dog & Pony Show", Specialty Mfg., 2005.

* cited by examiner

*Primary Examiner* — Benjamin Layno
(74) *Attorney, Agent, or Firm* — James L. Baudino

(57) ABSTRACT

A game of chance played between a plurality of players, which ensures there can be only one winner. Each player is associated with a set of indicators, and a winner is determined if a set of indicators associated with a player matches a unique set of indicators randomly selected from a pool of possible indicators. For a pool of a given size, the game calculates the unique combinations of a smaller number of indicators that can be generated from the pool. Each player is associated with one or more unique combinations, but each unique combination is associated with one and only one player. Indicators are randomly selected from the pool until all of the indicators in a first unique combination have been selected. The player associated with the first unique combination is the single winner of the game.

14 Claims, 5 Drawing Sheets

| B | I | N | G | O |
|---|---|---|---|---|
| 1 | 16 | 31 | 46 | 61 |
| 2 | 17 | 32 | 47 | 62 |
| 3 | 18 | 33 | 48 | 63 |
| 4 | 19 | 34 | 49 | 64 |
| 5 | 20 | 35 | 50 | 65 |
| 6 | 21 | 36 | 51 | 66 |
| 7 | 22 | 37 | 52 | 67 |
| 8 | 23 | 38 | 53 | 68 |
| 9 | 24 | 39 | 54 | 69 |
| 10 | 25 | 40 | 55 | 70 |
| 11 | 26 | 41 | 56 | 71 |
| 12 | 27 | 42 | 57 | 72 |
| 13 | 28 | 43 | 58 | 73 |
| 14 | 29 | 44 | 59 | 74 |
| 15 | 30 | 45 | 60 | 75 |

FIG. 2A

| B | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |

FIG. 2B

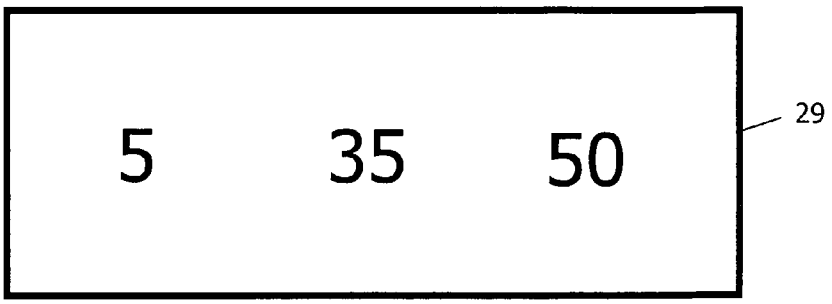
FIG. 4
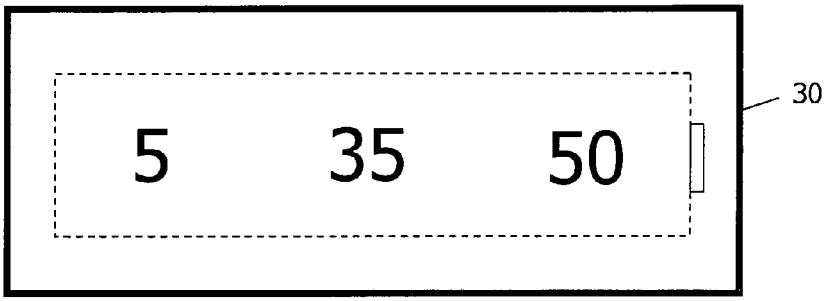
FIG. 5
| Play 1 | Play 2 | Play 3 |
|---|---|---|
| 3 | 32 | 66 |
| 10 | 39 | 71 |
| 14 | 43 | 75 |
31
FIG. 6

GAME OF CHANCE ENSURING A SINGLE WINNER

RELATED APPLICATIONS

This application is a continuation-in-part of U.S. patent application Ser. No. 11/323,544 filed Dec. 30, 2005 now U.S. Pat. No. 7,464,933.

BACKGROUND OF THE INVENTION

1. Technical Field of the Invention

This invention relates to games of chance. More particularly, and not by way of limitation, the invention is directed to a game of chance and a method that ensures a single unique winner.

2. Description of Related Art

Bingo is a game of chance played with a pool of numbers ranging from 1-75. There are many variations of the basic game of bingo, which is played on a square game-sheet having five rows and five columns forming 25 smaller squares. Each of the five columns is headed by one of the five letters in the word BINGO. The numbers 1-75 are divided into five groups of 15 numbers each, and each group of 15 numbers is associated with one of the letters in the word BINGO. In other words, the numbers 1-15 are associated with the letter 'B'; the numbers 16-30 are associated with the letter 'I'; the numbers 31-45 are associated with the letter 'N'; the numbers 46-60 are associated with the letter 'G'; and the numbers 61-75 are associated with the letter 'O'. On a player's game sheet, the five squares in each column are filled with five numbers randomly drawn from the 15 numbers associated with that column's letter. During the game, the House as a neutral party, randomly draws numbers between 1 and 75, and players match the drawn numbers with numbers on their game sheet. The first player to match all of the numbers in any row, column, or diagonal of their game sheet is a winner. However, since the numbers on the game sheets are random, and the numbers drawn are also random, it is possible to have more than one simultaneous winner.

FIG. 1 is a flow chart illustrating the steps of another known version of playing bingo. In this version, rather than playing with a 25 square game sheet, players are provided with small cards similar to instant-win lottery tickets. When opened, each card is printed with three numbers in the range of 1-75. A player wins whenever the three numbers on the player's card have been called.

In the example shown in FIG. 1, it is assumed that 1,000 cards are distributed to players. This number, of course, may be more or less. At step 11, the House prints (or has a vendor print) a large number of cards with three random numbers in the range of 1-75. At step 12, the House distributes 1,000 cards to the players. At step 13, the house randomly calls numbers in the range of 1-75. Generally, the called numbers are displayed on a large flashboard visible to all players. The positioning of the called numbers on the flashboard has no significance to the game. The flashboard is merely utilized as an aid to remind players which numbers have been called.

The House continues to call random numbers, until one or more simultaneous winners are determined. At step 14, the House pays out winnings to the simultaneous winners, which may theoretically be anywhere in the range of 1-1,000 simultaneous winners.

Other games of chance follow the same basic process. It is often desirable from the perspective of the House and the players to have a single unique winner of a game of chance. If the House promised a particular prize to the winner, and there were several simultaneous winners, the House may have to pay out more than anticipated. On the other hand, if a fixed amount is available for the winner, and there are several winners, then the fixed amount must be split between the winners.

SUMMARY OF THE INVENTION

Prior art methods of playing games of chance do not ensure a single unique winner. What is needed in the art is a game of chance and method that overcomes the shortcomings of prior art methods of playing games of chance. The present invention provides such a game and method.

Thus, in one embodiment, the present invention is directed to a method of playing a game of chance between a plurality of players, wherein each player is associated with at least one set of indicators, and a winner is determined if a set of indicators associated with a player matches a unique set of indicators randomly determined from a pool of possible indicators. The method, which ensures there can be only a single winner, includes the steps of dividing the pool of possible indicators into a predefined number of divisions; for each division, calculating the number of unique combinations of the indicators in the division taken in groups equal in size to the number of indicators in each player's set of indicators; and associating each unique combination with a different one of the plurality of players. Each player is associated with one or more unique combinations, but each unique combination is associated with one and only one player. The method also includes randomly selecting indicators from the pool of possible indicators until all of the indicators in a first unique combination have been selected; and determining a single winner as the player associated with the first unique combination.

In another embodiment, instead of dividing the pool of possible indicators into a predefined number of divisions, the method calculates the number of unique combinations of the indicators in the pool of possible indicators taken in groups equal in size to the number of indicators in each player's set of indicators. Thus, the method includes the steps of determining a plurality of unique combinations of the indicators in the pool, wherein the unique combinations include an equal number of indicators, and wherein the number of indicators in each unique combination is equal to or less than the number of indicators in the set of indicators associated with each player. The method also includes associating each unique combination with one of the plurality of players, wherein each player is associated with one or more unique combinations, but each unique combination is associated with one and only one player. Indicators are then randomly selected from the pool of possible indicators until all of the indicators in a first unique combination have been selected, and a single winner is determined as the player associated with the first unique combination.

In another aspect, the present invention is directed to a game of chance played between a plurality of players, wherein each player is associated with at least one set of indicators, and a winner is determined if a set of indicators associated with a player matches a unique set of indicators randomly selected from a pool of possible indicators. The game, which is adapted so that there can be only a single winner, includes means for determining a plurality of unique combinations of the indicators in the pool, wherein the unique combinations include an equal number of indicators, and the number of indicators in each unique combination is equal to or less than the number of indicators in the set of indicators associated with each game piece; and means for associating each unique combination with one of the plurality of players, wherein each player is associated with one or more unique combinations, but each unique combination is associated with one and only one player. The game also includes means for randomly selecting indicators from the pool of possible indicators until all of the indicators in a first unique combination have been selected. The player associated with the first unique combination is the single winner of the game.

BRIEF DESCRIPTION OF THE DRAWINGS

A more complete understanding of the present invention may be had by reference to the following Detailed Description when taken in conjunction with the accompanying drawings wherein:

FIGS. 2A and 2B are flashboards suitable for use with the game of chance of the present invention;

FIG. 4 is a game card with a set of three numbers between 1 and 75 printed thereon;

FIG. 5 is a sealed card for use by the House that contains the winning 3-number combination;

FIG. 6 is a game card with three 3-number combinations printed thereon in another embodiment of the present invention.

DETAILED DESCRIPTION OF EXEMPLARY EMBODIMENTS

As illustrative embodiments, the description herein primarily focuses on games of chance utilizing a 75-number flashboard. However, it should be understood that the present invention is not limited to games utilizing a board or to a 75-number range. The present invention is equally applicable to games such as 80-number Keno, 90-number Bingo, Roulette, and other games of chance utilizing a greater or lesser range of numbers.

The number of unique combinations of a given number of indicators from a larger pool of indicators can be calculated mathematically using the equation:

$$^{X}C_{Y}=X!/(X-Y)!\cdot Y!$$

where X is the number of indicators in the pool and Y is the number of indicators in each unique combination. For example, if there are 15 indicators in the pool and 4 indicators in each unique combination, there are 8,190 unique 4-indicator combinations in the pool calculated as follows:

$$\begin{aligned} {}^{15}C_4 &= 15!/(15-4)!\cdot 4! \\ &= 32,760/24 \\ &= 8,190 \end{aligned}$$

In one embodiment, the present invention is a 3-number bingo game and method of playing the game that ensures that there is only one winner. Each card eligible to play the game is printed with a unique 3-number combination. Therefore, the first player to match all three numbers on his card must be the only winner.

FIGS. 2A and 2B are flashboards suitable for use with the bingo game of the present invention. FIG. 2A illustrates a vertically oriented flashboard, and FIG. 2B illustrates a horizontally oriented flashboard. In the vertical orientation of FIG. 2A, there are five columns; each headed by one of the letters of the word BINGO, and each containing 15 sequential numbers. In the vertical orientation, each row contains five numbers, one from each of the five columns. In the horizontal orientation of FIG. 2B, there are five rows, each headed by one of the letters of the word BINGO, and each containing 15 sequential numbers. In the horizontal orientation, each column contains five numbers, one from each of the five rows.

Figure 1:
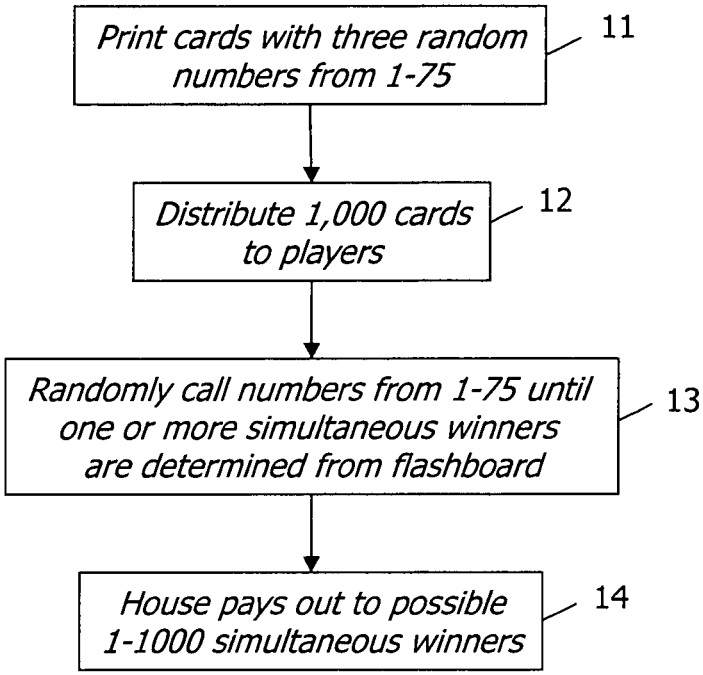
FIG. 1 (PRIOR ART)
FIG. 1 (Prior Art) is a flow chart illustrating the steps of a known method of playing bingo.
Figure 3:
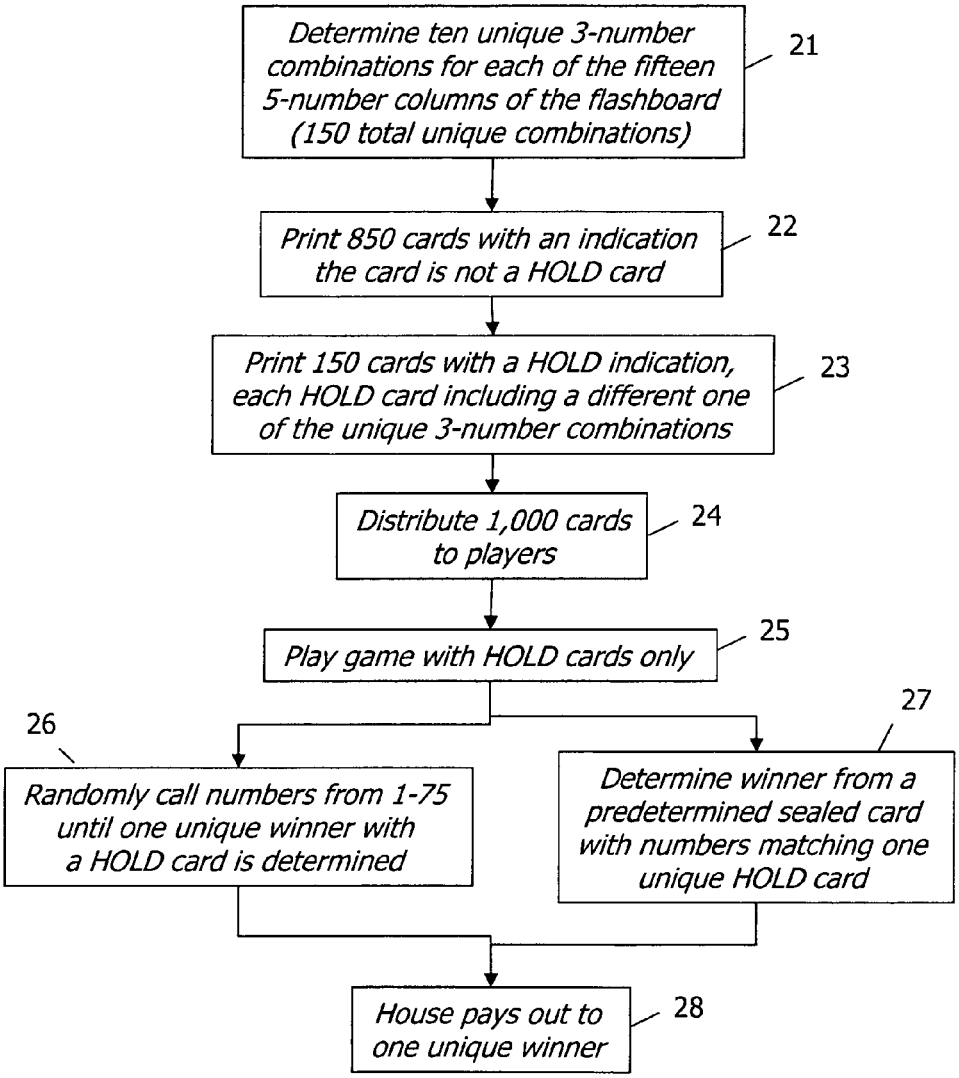
FIG. 3 is a flow chart illustrating the steps of an embodiment of a method of playing a game of chance in accordance with the teachings of the present invention.

FIG. 3 is a flow chart illustrating the steps of an embodiment of a method of playing bingo in accordance with the teachings of the present invention. At step 21, ten unique 3-number combinations are determined for each of the fifteen 5-number columns of the flashboard (assuming a horizontally oriented flashboard as shown in FIG. 2B). It can be shown mathematically that any set of five different numbers can be combined three at a time to form ten unique combinations. Mathematically, this is shown as follows:

$$\begin{aligned} {}^{5}C_3 &= 5!/(5-3)!\cdot 3! \\ &= 120/(2\cdot 6) \\ &= 120/12 \\ &= 10 \end{aligned}$$

Since the flashboard has fifteen 5-number columns, there are a total of 150 unique 3-number combinations, when combinations are formed one column at a time. Assuming once again that 1,000 cards are to be distributed to players, 850 cards are printed at step 22 with an indication that the card is not a HOLD card (or alternatively, these cards are printed without an indication that the card is a HOLD card). At step 23, 150 cards are printed with a HOLD indication. Each HOLD card includes a different one of the 150 unique 3-number combinations. At step 24, the House distributes the 1,000 cards to the players. At step 25, the bingo game is played with the HOLD cards only.

In alternative embodiments, the game may be played with pull-tab tickets, scratch-off tickets, as a paper game, as an electronic game in which the players have electronic virtual game pieces rather than physical game pieces, or in any other manner in which winning combinations are selected from a pool of possible indicators. For example, a player may select a combination and be associated directly with the combination, without the use of a game piece.

A winner may be determined in alternative ways. At step 26, the House randomly calls numbers from the range of 1-75, until one unique winner with a HOLD card is determined. Since each of the 150 3-number combinations on the HOLD cards is unique, there can be only one winner. Additionally, when combinations are formed one column at a time as described above, the House can quickly determine that there has been a winner whenever three numbers in any one column have been drawn. This is because each 3-number combination has been uniquely assigned to a single HOLD card.

In an alternative embodiment, a winner may be determined at step 27 by opening a predetermined sealed card matching one of the 150 unique 3-number combinations on the HOLD cards. Once again, there can be only one winner. From step 26 or 27, the method proceeds to step 28, where the House pays out to the one unique winner.

In the embodiment shown and described above, each HOLD card has a 1 in 150 chance of being a winner. The odds may be changed in other embodiments by computing different combinations and printing a set of HOLD cards reflecting the new combinations. For example, still referring to FIG. 2B, combinations may be computed for the number of combinations of the 15 numbers in each row taken three at a time. Mathematically, this is shown as follows:

$$
\begin{aligned}
{}^{15}C_3 &= 15!/(15-3)!\cdot 3! \\
&= (15\cdot 14\cdot 13)/6 \\
&= 2,730/6 \\
&= 455
\end{aligned}
$$

Thus, there are 455 unique 3-number combinations in each row of the flashboard illustrated in FIG. 2B. Since the flashboard has five 15-number rows, there are a total of 455×5=2,275 unique 3-number combinations, when combinations are formed one row at a time. Thus in this embodiment, each HOLD card has a 1 in 2,275 chance of being a winner.

Other combinations of the numbers on the flashboard may also be utilized to achieve different odds of winning. At one extreme, if combinations are computed for all 75 numbers on the flashboard taken three at a time, it is found that there are 67,525 unique 3-number combinations. In such an embodiment, each HOLD card has a 1 in 67,525 chance of being a winner.

In another exemplary embodiment, intermediate odds of winning may be achieved by computing combinations on a per column basis for a predefined number of columns, and then computing combinations for the remaining partial rows. For example, combinations may be computed for the first eight 5-number columns in the manner shown in the first embodiment above. This calculation results in a total of 80 unique 3-number combinations. Combinations may then be calculated on a row-by-row basis for the remaining seven positions. For each partial row (i.e., positions nine through 15), there are 35 combinations of the seven numbers taken three at a time. Since there are five such partial rows, there are an additional 175 unique 3-number combinations. Thus, the total number of unique combinations in this embodiment is 80+175=255. If a hold card is printed for each unique 3-number combination, each HOLD card has a 1 in 255 chance of being a winner.

In each embodiment, since each HOLD card includes a unique 3-number combination, there can be only one winner.

FIG. 4 is a game card with a set of three numbers between 1 and 75 printed thereon.

FIG. 5 is a sealed card for use by the House that contains the winning 3-number combination.

FIG. 6 is a game card with three 3-number combinations printed thereon in another embodiment of the present invention. Each game card may be associated with more than one number combination, providing players with more numbers to watch and a greater change of winning. To ensure there is only one winner, however, each of the unique 3-number combinations can only be associated with a single game card.

Figure 7:
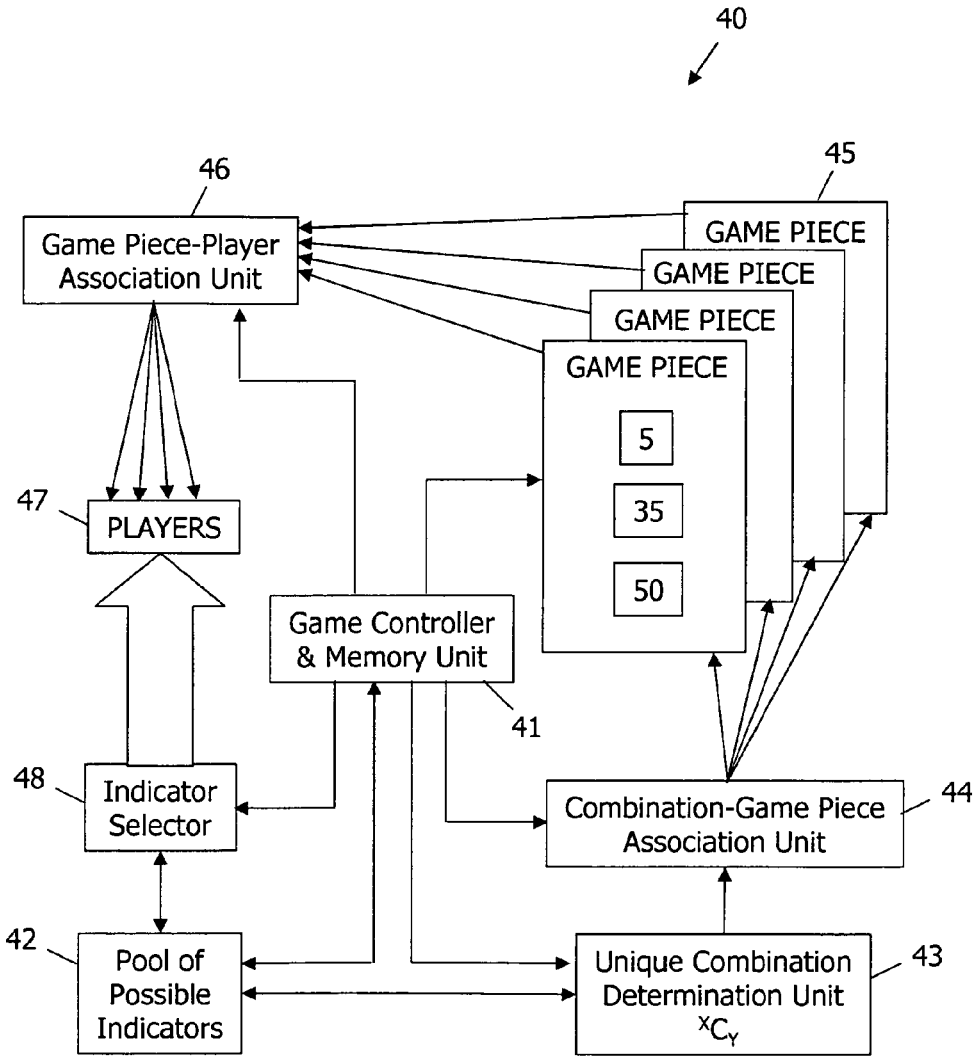
FIG. 7 is a block diagram of an exemplary embodiment of the game of chance of the present invention.

FIG. 7 is a block diagram of an exemplary embodiment of the game of chance 40 of the present invention. The game may be controlled by a game controller (processor) and memory unit 41. In one embodiment, the memory unit stores a pool of possible indicators, and in another embodiment, the memory unit stores program instructions which, when run on the controller, cause the game to operate in accordance with the method of the present invention. In another embodiment, the controller accesses a separate pool of possible indicators 42 and causes a Unique Combination Determination Unit 43 to determine all of the unique combinations of indicators for combinations of a given size (Y) within a pool of a larger size (X). The results are provided to a Combination-Game Piece Association Unit 44. The Association Unit associates each unique combination with a different game piece 45.

The Game Controller 41 may create the game pieces 45 if the game is an electronic game and the game pieces are electronic virtual game pieces. Alternatively, the game pieces may be printed on paper or manufactured as pull-tab or scratch-off tickets by another source, which has been provided with the information from the Combination-Game Piece Association Unit 44. Once the game pieces are created, a Game Piece-Player Association Unit 46 associates the game pieces with players 47, and the game is ready to be played.

To play the game, an Indicator Selector 48 randomly selects indicators from the pool 42. Each selected indicator is presented to the players 47 so that they can determine whether the selected indicator is on their game piece 45. Eventually, all of the indicators in one of the unique combinations will be selected. The player having the game piece associated with the first unique combination is then declared the single winner of the game of chance.

As will be recognized by those skilled in the art, the innovative concepts described in the present application can be modified and varied over a wide range of applications. For example, the pool of numbers being played may be greater or lesser than 75, and the HOLD cards may include greater or lesser than three numbers. Note also that the indicators do not have to be numbers, but can be letters or any type of symbol or indicator in which each individual indicator can be distinguished from another. Accordingly, the scope of patented subject matter should not be limited to any of the specific exemplary teachings discussed above, but is instead defined by the following claims.

What is claimed is:

1. A method for administering a game of chance, comprising:

providing a plurality of game pieces to one or more players, each game piece having a unique combination of indicators, the plurality of game pieces equal to a number of unique combinations of indicators; and determining a winning combination of indicators matching one and only one of the unique combinations.

2. The method of claim 1, wherein determining the winning combination comprises randomly selecting indicators corresponding to the indicators provided on the game pieces to obtain a combination of indicators matching one an only one of the game pieces.

3. The method of claim 1, wherein providing the plurality of game pieces comprises providing the game pieces each with a unique combination of numbers.

4. The method of claim 1, wherein providing the plurality of game pieces comprises providing a plurality of printed game pieces.

5. The method of claim 1, wherein providing the plurality of game pieces comprises providing electronic virtual game pieces.

6. The method of claim 1, further comprising:

determining a pool of possible indicators;

selecting a quantity of indicators to form a unique combination of indicators; and determining, for the pool of possible indicators, the unique combinations of indicators each having the selected quantity of indicators.

7. A method of manufacturing a game of chance, comprising:

identifying a quantity of unique combinations of indicators; and creating a plurality of game pieces, each game piece having associated therewith one of the unique combinations of indicators, the quantity of game pieces for the game of chance corresponding to the quantity of unique combinations of indicators such that one and only one game piece wins the game of chance based on a selection of one of the unique combinations of indicators.

8. The method of claim 7, wherein creating the plurality of game pieces comprises printing on each game piece one of the unique combinations of indicators.

9. The method of claim 7, further comprising:

determining a pool of possible indicators;

selecting a quantity of indicators to form a unique combination of indicators; and determining, for the pool of possible indicators, each unique combination of indicators wherein each unique combination comprises the selected quantity of indicators.

10. The method of claim 7, wherein creating the plurality of game pieces comprises creating a plurality of scratch-off game pieces.

11. The method of claim 7, wherein creating the plurality of game pieces comprises creating a plurality of pull-tab tickets.

12. A game of chance, comprising:

a plurality of game pieces distributable to a plurality of players, each game piece having associated therewith a unique combination of indicators, and wherein a quantity of game pieces for the game is equal to a number of unique combinations of indicators such that one and only one game piece wins the game of chance based on a selection of one of the unique combinations of indicators.

13. The game of claim 12, wherein the unique combination of indicators comprises a unique combination of numbers.

14. The game of claim 12, wherein the unique combination of indicators comprises a unique combination of three numbers.

* * * * *